US009951589B2

(12) United States Patent
Wilson

(10) Patent No.: US 9,951,589 B2
(45) Date of Patent: Apr. 24, 2018

(54) LOW ANGLE BOTTOM CIRCULATOR SHAPED CHARGE

(71) Applicant: Hunting Titan, Inc., Pampa, TX (US)

(72) Inventor: Shane Matthew Wilson, Waxahachie, TX (US)

(73) Assignee: Hunting Titan, Inc., Pampa, TX (US)

( * ) Notice: Subject to any disclaimer, the term of this patent is extended or adjusted under 35 U.S.C. 154(b) by 0 days.

(21) Appl. No.: 15/314,419

(22) PCT Filed: May 29, 2015

(86) PCT No.: PCT/US2015/033280
§ 371 (c)(1),
(2) Date: Nov. 28, 2016

(87) PCT Pub. No.: WO2015/184323
PCT Pub. Date: Dec. 3, 2015

(65) Prior Publication Data

US 2017/0122083 A1 May 4, 2017

Related U.S. Application Data

(60) Provisional application No. 62/005,356, filed on May 30, 2014.

(51) Int. Cl.
*E21B 43/117* (2006.01)
*F42B 1/028* (2006.01)
*F42B 3/08* (2006.01)

(52) U.S. Cl.
CPC ..... *E21B 43/117* (2013.01); *F42B 1/028* (2013.01); *F42B 3/08* (2013.01)

(58) Field of Classification Search
CPC ..... E21B 43/117
See application file for complete search history.

(56) References Cited

U.S. PATENT DOCUMENTS

| | | | | |
|---|---|---|---|---|
| 2,513,233 A | | 6/1950 | Byers | |
| 2,760,408 A | | 8/1956 | Taylor | |
| 2,856,850 A | | 10/1958 | Church et al. | |
| 3,177,808 A | * | 4/1965 | Owen | E21B 43/117 102/310 |
| 3,237,559 A | * | 3/1966 | Auberlinder | E21B 43/117 102/306 |
| 4,436,033 A | | 3/1984 | Precoul | |
| 4,474,113 A | * | 10/1984 | Kyro | F42B 1/028 102/306 |
| 4,655,138 A | * | 4/1987 | Regalbuto | F42B 3/08 102/307 |
| 4,672,896 A | | 6/1987 | Precoul | |
| 6,668,726 B2 | | 12/2003 | Lussier | |
| 6,840,178 B2 | | 1/2005 | Collins et al. | |
| 2004/0200377 A1 | | 10/2004 | Collins et al. | |

FOREIGN PATENT DOCUMENTS

FR 1209827 A 3/1960

OTHER PUBLICATIONS

Notification of Transmittal of the International Search Report and Written Opinion of the International Searching Authority, PCT Application No. PCT/US15/33280, dated Aug. 29, 2015, 12 pages.

* cited by examiner

*Primary Examiner* — Shane Bomar
(74) *Attorney, Agent, or Firm* — Jason Saunders; Christopher McKeon; Arnold & Saunders, LLP

(57) ABSTRACT

A system and apparatus for reducing over penetration of a tubular with a shaped charge.

55 Claims, 4 Drawing Sheets

LOW ANGLE BOTTOM CIRCULATOR SHAPED CHARGE

RELATED APPLICATIONS

This application claims priority to U.S. Provisional Application No. 62/005,356, filed May 30, 2014 for, "Low Angle Bottom, Pressed Powdered Metal Liners Used for Circulator Charges."

FIELD

The invention generally relates to perforating guns used in a subterranean environment. More particularly, the invention relates to a shallow angle bottom circulator shaped charge designed for perforating through casing while reducing the risk of damaging adjacent casing.

BACKGROUND OF THE INVENTION

Generally, when completing a subterranean well for the production of fluids, minerals, or gases from underground reservoirs, several types of tubulars are placed downhole as part of the drilling, exploration, and completions process. These tubulars can include casing, tubing, pipes, liners, and devices conveyed downhole by tubulars of various types. Each well is unique, so combinations of different tubulars may be lowered into a well for a multitude of purposes.

A subsurface or subterranean well transits one or more formations. The formation is a body of rock or strata that contains one or more compositions. The formation is treated as a continuous body. Within the formation hydrocarbon deposits may exist. Typically a wellbore will be drilled from a surface location, placing a hole into a formation of interest. Completion equipment will be put into place, including casing, tubing, and other downhole equipment as needed. Perforating the casing and the formation with a perforating gun is a well known method in the art for accessing hydrocarbon deposits within a formation from a wellbore.

Explosively perforating the formation using a shaped charge is a widely known method for completing an oil well. A shaped charge is a term of art for a device that when detonated generates a focused explosive output. This is achieved in part by the geometry of the explosive in conjunction with a liner in the explosive material. Generally, a shaped charge includes a metal case that contains an explosive material with a concave shape, which has a thin metal liner on the inner surface. Many materials are used for the liner; some of the more common metals include brass, copper, tungsten, and lead. When the explosive detonates the liner metal is compressed into a super-heated, super pressurized jet that can penetrate metal, concrete, and rock.

A perforating gun has a gun body. The gun body typically is composed of metal and is cylindrical in shape. Within a typical gun tube is a charge holder, which is a tube that is designed to hold the actual shaped charges. The charge holder will contain cutouts called charge holes where the shaped charges will be placed.

A shaped charge is a term of art for a device that when detonated generates a focused explosive output. This is achieved in part by the geometry of the explosive in conjunction with a liner in the explosive material. Many materials are used for the liner; some of the more common metals include brass, copper, tungsten, and lead. When the explosive detonates the liner metal is compressed into a super-heated, super pressurized jet that can penetrate metal, concrete, and rock.

A shaped charge can do cause considerable damage and penetrate through layers of metal, concrete, and rock. In some applications, the further a shaped charge can penetrate its intended target the better. However, there are applications where over penetration is a concern. For instance, there are applications where a there are tubulars located within other tubulars, or tubulars located proximate to each other. In these applications there might be a need to puncture through one tubular but minimize the risk of puncturing another tubular.

SUMMARY OF EXAMPLES OF THE INVENTION

In at least one example of the invention, the invention comprises a shaped charge liner comprising a first section having a first axis, a substantially conical first inner surface, a first outer surface, and a first conical angle respective to the first inner surface, a second section having a second axis, a substantially frusto-conical second inner surface, a second outer surface, and a second conical angle respective to the second inner surface, a third section having a third axis, a substantially frusto-conical third inner surface, a third outer surface, and a third conical angle respective to the third inner surface, wherein the first section, second section and third section are axially aligned, the first conical angle is larger than the second conical angle and the second conical angle is larger than the third conical angle.

The example further comprises a top surface having an inner edge, an outer edge and a top surface, wherein the inner edge is proximate with the third inner surface and the top surface is substantially perpendicular to the first axis. In another example the top surface further comprises an exterior cylindrical surface parallel to the shared axis wherein the cylindrical surface is proximate to the third outer surface. In another example the second outer surface and the third outer surface are substantially aligned to form a continuous surface. In another example the second section has a first height measured along the first axis from the first inner surface to the third inner surface, the third section has a second height measured along the first axis from the second inner surface to the furthest edge of the third inner surface, and the second height is no more than the first height.

In another example the intersection of the inner edge of the top surface and the third inner surface forms a first fillet with a first radius. In another example the intersection of the outer edge of the top surface and the cylindrical surface forms a second fillet with a second radius. In another example the first radius is between approximately 0.015 and 0.025 inches. In another example the second radius is between approximately 0.015 and 0.025 inches. In another example the first inner surface of the first section has a convex shape. In another example the first inner surface of the first section has a concave shape. In another example the first conical angle is approximately 180 degrees. In another example the first conical angle is less than 180 degrees. In another example the first conical angle is more than 180 degrees.

In another example the first section has a first diameter and the top surface has a second diameter and the first diameter ratio to the second diameter is between 0.15 and 0.45. In another example the second conical angle is between 100 and 130 degrees. In another example the second conical angle is between 108 and 124 degrees. In another example the first conical angle is less than 180 degrees and the second conical angle is between 100 and 130 degrees. In another example the first conical angle is less than 180 degrees and the second conical angle is between 108 and 124 degrees. In another example the third conical angle is between 56 and 94 degrees. In another example the first conical angle is less than 180 degrees, the second conical angle is between 100 and 130 degrees, and the third conical angle is between 56 and 94 degrees. In another example the first conical angle is less than 180 degrees, the second conical angle is between 108 and 124 degrees, and the third conical angle is between 56 and 94 degrees. In another example the length of the cylindrical surface along the first axis is between 0.030 and 0.040 inches. In another example the second outer surface has a fourth conical angle between 112 and 124 degrees. In another example the third outer surface has a fifth conical angle between 68 and 98 degrees.

In another example the second outer surface has a fourth conical angle, the third outer surface has a fifth conical angle, and the fourth conical angle is approximately equal to the fifth conical angle. In another example the first height is between 0.083 and 0.132 inches. In another example the second height is between 0.140 and 0.240 inches. In another example the first height is between 0.080 and 0.132 inches and the second height is between 0.140 and 0.240 inches. In another example the first height is approximately 0.137 inches, the second height is approximately 0.245 inches, the first conical angle is less than 180 degrees, the second conical angle is approximately 124 degrees, and the third conical angle is approximately 68 degrees. In another example the first height is approximately 0.087 inches, the second height is approximately 0.170 inches, the first conical angle is less than 180 degrees, the second conical angle is approximately 114 degrees, and the third conical angle is approximately 56 degrees. In another example the first height is approximately 0.090 inches, the second height is approximately 0.160 inches, the first conical angle is less than 180 degrees, the second conical angle is approximately 118 degrees, and the third conical angle is approximately 94 degrees.

In another example the first height is approximately 0.123 inches, the second height is approximately 0.235 inches, the first conical angle is less than 180 degrees, the second conical angle is approximately 108 degrees, and the third conical angle is approximately 56 degrees.

In another example the first height is approximately 0.105 inches, the second height is approximately 0.205 inches, the first conical angle is less than 180 degrees, the second conical angle is approximately 114 degrees, and the third conical angle is approximately 62 degrees. In another example the first height is approximately 0.127 inches, the second height is approximately 0.223 inches, the first conical angle is less than 180 degrees, the second conical angle is approximately 118 degrees, and the third conical angle is approximately 94 degrees. In another example the first height is approximately 0.123 inches, the second height is approximately 0.218 inches, the first conical angle is less than 180 degrees, the second conical angle is approximately 124 degrees, and the third conical angle is approximately 62 degrees. In another example the first height is approximately 0.123 inches, the second height is approximately 0.218 inches, the first conical angle is less than 180 degrees, the second conical angle is approximately 124 degrees, and the third conical angle is approximately 62 degrees.

Another example of the invention is a shaped charge explosive comprising a case with a first opening and an inner wall a liner further comprising a first section, a second section, and a third section, the first section having a first axis, a substantially conical first inner surface, a first outer surface, and a first conical angle respective to the first inner surface, the second section having a second axis, a substantially frusto-conical second inner surface, a second outer surface, and a second conical angle respective to the second inner surface, the third section having a third axis, a substantially frusto-conical third inner surface, a third outer surface, and a third conical angle respective to the third inner surface, wherein the first section, second section and third section are axially aligned, the first conical angle is larger than the second conical angle and the second conical angle is larger than the third conical angle, an explosive located between the liner and the inner wall of the case.

Another example of the invention includes a top surface having an inner edge, an outer edge and a top surface, wherein the inner edge is proximate with the third inner surface and the top surface is substantially perpendicular to the first axis. Another example of the invention includes the top surface further comprising an exterior cylindrical surface parallel to the shared axis wherein the cylindrical surface is proximate to the third outer surface.

Another example of the invention includes the second outer surface and the third outer surface being substantially aligned to form a continuous surface. An example may include the second section having a first height measured along the first axis from the first inner surface to the third inner surface, the third section having a second height measured along the first axis from the second inner surface to the furthest edge of the third inner surface, and the second height is no more than the first height.

Another example of the invention includes the intersection of the inner edge of the top surface and the third inner surface forming a first fillet with a first radius. Another example of the invention includes the intersection of the outer edge of the top surface and the cylindrical surface forming a second fillet with a second radius. Another example of the invention includes the first radius being between approximately 0.015 and 0.025 inches. Another example of the invention includes the second radius being between approximately 0.015 and 0.025 inches.

Another example of the invention includes the first inner surface of the first section having a convex shape. Another example of the invention includes the first inner surface of the first section having a concave shape. Another example of the invention includes the first conical angle being approximately 180 degrees. Another example of the invention includes the first conical angle being less than 180 degrees. Another example of the invention includes the first conical angle being more than 180 degrees.

Another example of the invention includes the first section having a first diameter and top surface having a second diameter and the first diameter ratio to the second diameter is between 0.15 and 0.45. Another example of the invention includes the second conical angle being between 100 and 130 degrees. Another example of the invention includes the second conical angle being between 108 and 124 degrees. Another example of the invention includes the first conical angle being less than 180 degrees and the second conical angle being between 100 and 130 degrees. Another example of the invention includes the first conical angle being less than 180 degrees and the second conical angle being between 108 and 124 degrees. Another example of the invention includes the third conical angle being between 56 and 94 degrees. Another example of the invention includes the first conical angle being less than 180 degrees, the second conical angle being between 100 and 130 degrees, and the third conical angle being between 56 and 94 degrees. Another example of the invention includes the first conical angle being less than 180 degrees, the second conical angle being between 108 and 124 degrees, and the third conical angle being between 56 and 94 degrees.

Another example of the invention includes the length of the cylindrical surface along the first axis being between 0.030 and 0.040 inches. Another example of the invention includes the second outer surface having a fourth conical angle between 112 and 124 degrees. Another example of the invention includes the third outer surface having a fifth conical angle between 68 and 98 degrees. Another example of the invention includes the second outer surface having a fourth conical angle, the third outer surface having a fifth conical angle, and the fourth conical angle is approximately equal to the fifth conical angle. Another example of the invention includes the first height being between 0.080 and 0.132 inches. Another example of the invention includes the second height being between 0.140 and 0.240 inches. Another example of the invention includes the first height being between 0.080 and 0.132 inches and the second height being between 0.140 and 0.240 inches.

In a variation of at least one example of the invention, the first height is approximately 0.137 inches, the second height is approximately 0.245 inches, the first conical angle is less than 180 degrees, the second conical angle is approximately 124 degrees, and the third conical angle is approximately 68 degrees. In a variation of at least one example of the invention, the first height is approximately 0.087 inches, the second height is approximately 0.170 inches, the first conical angle is less than 180 degrees, the second conical angle is approximately 114 degrees, and the third conical angle is approximately 56 degrees.

In a variation of at least one example of the invention, the first height is approximately 0.090 inches, the second height is approximately 0.160 inches, the first conical angle is less than 180 degrees, the second conical angle is approximately 118 degrees, and the third conical angle is approximately 94 degrees.

In a variation of at least one example of the invention, the first height is approximately 0.123 inches, the second height is approximately 0.235 inches, the first conical angle is less than 180 degrees, the second conical angle is approximately 108 degrees, and the third conical angle is approximately 56 degrees.

In a variation of at least one example of the invention, the first height is approximately 0.105 inches, the second height is approximately 0.205 inches, the first conical angle is less than 180 degrees, the second conical angle is approximately 114 degrees, and the third conical angle is approximately 62 degrees.

In a variation of at least one example of the invention, the first height is approximately 0.127 inches, the second height is approximately 0.223 inches, the first conical angle is less than 180 degrees, the second conical angle is approximately 118 degrees, and the third conical angle is approximately 94 degrees.

In a variation of at least one example of the invention, the first height is approximately 0.123 inches, the second height is approximately 0.218 inches, the first conical angle is less than 180 degrees, the second conical angle is approximately 124 degrees, and the third conical angle is approximately 62 degrees.

In a variation of at least one example of the invention, the first height is approximately 0.123 inches, the second height is approximately 0.218 inches, the first conical angle is less than 180 degrees, the second conical angle is approximately 124 degrees, and the third conical angle is approximately 62 degrees.

Another example of the invention includes a perforating gun comprising at least one shaped charge further comprising, a case with a first opening, a second opening, and an inner wall, a case with a first opening, a second opening, and an inner wall, a liner further comprising a first section having a first axis, a substantially conical first inner surface, a first outer surface, and a first conical angle respective to the first inner surface, a second section having a second axis, a substantially frusto-conical second inner surface, a second outer surface, and a second conical angle respective to the second inner surface, a third section having a third axis, a substantially frusto-conical third inner surface, a third outer surface, and a third conical angle respective to the third inner surface, wherein the first section, second section and third section are axially aligned, the first conical angle is larger than the second conical angle and the second conical angle is larger than the third conical angle, and a gun carrier housing adapted to contain the at least one shaped charge.

In a variation of at least one example of the invention, including a top surface having an inner edge, an outer edge and a top surface, wherein the inner edge is proximate with the third inner surface and the top surface is substantially perpendicular to the first axis.

In a variation of at least one example of the invention, the top surface further comprises an exterior cylindrical surface parallel to the shared axis wherein the cylindrical surface is proximate to the third outer surface. In a variation of at least one example of the invention, the second outer surface and the third outer surface are substantially aligned to form a continuous surface.

In a variation of at least one example of the invention, the second section has a first height measured along the first axis from the first inner surface to the third inner surface, the third section has a second height measured along the first axis from the second inner surface to the furthest edge of the third inner surface, and the second height is no more than the first height. In a variation of at least one example of the invention, the intersection of the inner edge of the top surface and the third inner surface forms a first fillet with a first radius. In a variation of at least one example of the invention, the intersection of the outer edge of the top surface and the cylindrical surface forms a second fillet with a second radius. In a variation of at least one example of the invention, the first radius is between approximately 0.015 and 0.025 inches.

In a variation of at least one example of the invention, the second radius is between approximately 0.015 and 0.025 inches. In a variation of at least one example of the invention, the first inner surface of the first section has a convex shape. In a variation of at least one example of the invention, the first inner surface of the first section has a concave shape.

In a variation of at least one example of the invention, the first conical angle is approximately 180 degrees. In a variation of at least one example of the invention, the first conical angle is less than 180 degrees. In a variation of at least one example of the invention, the first conical angle is more than 180 degrees. In a variation of at least one example of the invention, wherein the first section has a first diameter and top surface has a second diameter and the first diameter ratio to the second diameter is between 0.15 and 0.45. In a variation of at least one example of the invention, the second conical angle is between 100 and 130 degrees. In a variation of at least one example of the invention, the second conical angle is between 108 and 124 degrees.

In a variation of at least one example of the invention, the first conical angle is less than 180 degrees and the second conical angle is between 100 and 130 degrees. In a variation of at least one example of the invention, the first conical angle is less than 180 degrees and the second conical angle is between 108 and 124 degrees. In a variation of at least one example of the invention, the third conical angle is between 56 and 94 degrees. In a variation of at least one example of the invention, the first conical angle is less than 180 degrees, the second conical angle is between 100 and 130 degrees, and the third conical angle is between 56 and 94 degrees. In a variation of at least one example of the invention, the first conical angle is less than 180 degrees, the second conical angle is between 108 and 124 degrees, and the third conical angle is between 56 and 94 degrees. In a variation of at least one example of the invention, the length of the cylindrical surface along the first axis is between 0.030 and 0.040 inches. In a variation of at least one example of the invention, the second outer surface has a fourth conical angle between 112 and 124 degrees. In a variation of at least one example of the invention, the third outer surface has a fifth conical angle between 68 and 98 degrees.

In a variation of at least one example of the invention, the second outer surface has a fourth conical angle, the third outer surface has a fifth conical angle, and the fourth conical angle is approximately equal to the fifth conical angle. In a variation of at least one example of the invention, the first height is between 0.080 and 0.132 inches. In a variation of at least one example of the invention, the second height is between 0.140 and 0.240 inches. In a variation of at least one example of the invention, the first height is between 0.080 and 0.132 inches and the second height is between 0.140 and 0.240 inches. In a variation of at least one example of the invention, the first height is approximately 0.137 inches, the second height is approximately 0.245 inches, the first conical angle is less than 180 degrees, the second conical angle is approximately 124 degrees, and the third conical angle is approximately 68 degrees.

In a variation of at least one example of the invention, the first height is approximately 0.087 inches, the second height is approximately 0.170 inches, the first conical angle is less than 180 degrees, the second conical angle is approximately 114 degrees, and the third conical angle is approximately 56 degrees. In a variation of at least one example of the invention, the first height is approximately 0.090 inches, the second height is approximately 0.160 inches, the first conical angle is less than 180 degrees, the second conical angle is approximately 118 degrees, and the third conical angle is approximately 94 degrees. In a variation of at least one example of the invention, the first height is approximately 0.123 inches, the second height is approximately 0.235 inches, the first conical angle is less than 180 degrees, the second conical angle is approximately 108 degrees, and the third conical angle is approximately 56 degrees.

In a variation of at least one example of the invention, the first height is approximately 0.105 inches, the second height is approximately 0.205 inches, the first conical angle is less than 180 degrees, the second conical angle is approximately 114 degrees, and the third conical angle is approximately 62 degrees.

In a variation of at least one example of the invention, the first height is approximately 0.127 inches, the second height is approximately 0.223 inches, the first conical angle is less than 180 degrees, the second conical angle is approximately 118 degrees, and the third conical angle is approximately 94 degrees. In a variation of at least one example of the invention, the first height is approximately 0.123 inches, the second height is approximately 0.218 inches, the first conical angle is less than 180 degrees, the second conical angle is approximately 124 degrees, and the third conical angle is approximately 62 degrees. In a variation of at least one example of the invention, the first height is approximately 0.123 inches, the second height is approximately 0.218 inches, the first conical angle is less than 180 degrees, the second conical angle is approximately 124 degrees, and the third conical angle is approximately 62 degrees.

An example of the invention includes a method of perforating a well comprising providing a perforating gun, mounting at least one shaped charge in the perforating gun, the shaped charge comprising a casing, placing a liner within said casing, said liner comprising, a first axis, a substantially conical first inner surface, a first outer surface, and a first conical angle respective to the first inner surface, a second section having a second axis, a substantially frusto-conical second inner surface, a second outer surface, and a second conical angle respective to the second inner surface, a third section having a third axis, a substantially frusto-conical third inner surface, a third outer surface, and a third conical angle respective to the third inner surface, wherein the first section, second section and third section are axially aligned, the first conical angle is larger than the second conical angle and the second conical angle is larger than the third conical angle, placing an explosive material disposed in between said liner and said casing, connecting a firing head to the perforating gun, placing the perforating gun in said well at a desired location within the well, and detonating the at least one shaped charge at the desired location.

An example of the invention includes a shaped charge explosive comprising a case with a first opening and an inner wall, a liner further comprising a first section, a second section, and a third section. The first section having a first axis, a substantially conical first inner surface, and a first conical angle respective to the first inner surface. The second section having a second axis, a substantially frusto-conical second inner surface, and a second conical angle respective to the second inner surface. The third section having a third axis, a substantially frusto-conical third inner surface, and a third conical angle respective to the third inner surface. Furthermore, the first section, second section and third section are axially aligned, the first conical angle is larger than the second conical angle and the second conical angle is larger than the third conical angle. An explosive is located between the liner and the inner wall of the case.

An example of the invention may include a perforating gun comprising at least one shaped charge further comprising a case with a first opening, a second opening, and an inner wall. A case with a first opening, a second opening, and an inner wall. A liner further comprising a first section having a first axis, a substantially conical first inner surface, and a first conical angle respective to the first inner surface. A second section having a second axis, a substantially frusto-conical second inner surface, and a second conical angle respective to the second inner surface. A third section having a third axis, a substantially frusto-conical third inner surface, and a third conical angle respective to the third inner surface. Furthermore the first section, second section and third section are axially aligned where the first conical angle is larger than the second conical angle and the second conical angle is larger than the third conical angle. The invention may include a gun carrier housing adapted to contain the at least one shaped charge.

An example of the invention may include a method of perforating a well, comprising providing a perforating gun, mounting at least one shaped charge in the perforating gun, the shaped charge comprising a casing and placing a liner within said casing. Said liner comprising a first axis, a substantially conical first inner surface, and a first conical angle respective to the first inner surface. A second section having a second axis, a substantially frusto-conical second inner surface, and a second conical angle respective to the second inner surface. A third section having a third axis, a substantially frusto-conical third inner surface, and a third conical angle respective to the third inner surface, wherein the first section, second section and third section are axially aligned, the first conical angle is larger than the second conical angle and the second conical angle is larger than the third conical angle. The method may include placing an explosive material disposed in between said liner and said casing, connecting a firing head to the perforating gun, placing the perforating gun in said well at a desired location within the well, and detonating the at least one shaped charge at the desired location.

A variation of the examples disclosed may include the second section having a first height measured along the first axis from the first inner surface to the third inner surface, the third section having a second height measured along the first axis from the second inner surface to the furthest edge of the third inner surface, where the second height is no more than the first height. The first inner surface of the first section may have a convex shape. The first inner surface of the first section may have a concave shape. The first conical angle may be approximately 180 degrees or more than 180 degrees. The first section may have a first outer diameter and the third section may have a second outer diameter and the ratio of the first diameter to the second diameter is between 0.15 and 0.45. The second conical angle may be between 108 and 124 degrees. The first conical angle may be less than 180 degrees and the second conical angle may be between 108 and 124 degrees. The third conical angle may be between 56 and 94 degrees. The first conical angle may be less than 180 degrees, where the second conical angle is between 100 and 130 degrees, and the third conical angle is between 56 and 94 degrees. The first conical angle may be less than 180 degrees, where the second conical angle is between 108 and 124 degrees, and the third conical angle is between 56 and 94 degrees. The first height may be between 0.080 and 0.132 inches. The second height may be between 0.140 and 0.240 inches. The first height may be between 0.080 and 0.132 inches and the second height may be between 0.140 and 0.240 inches.

DESCRIPTION OF THE DRAWINGS

For a thorough understanding of the present invention, reference is made to the following detailed description of the preferred embodiments, taken in conjunction with the accompanying drawings in which reference numbers designate like or similar elements throughout the several figures of the drawing. Briefly.

DETAILED DESCRIPTION OF EXAMPLES OF THE INVENTION

In the following description, certain terms have been used for brevity, clarity, and examples. No unnecessary limitations are to be implied there from and such terms are used for descriptive purposes only and are intended to be broadly construed. The different apparatus, systems and method steps described herein may be used alone or in combination with other apparatus, systems and method steps. It is to be expected that various equivalents, alternatives, and modifications are possible within the scope of the appended claims. For instance, an energetic device in this specification may include, but is not limited to, a shaped charge or a jet cutter.

Figure 1:
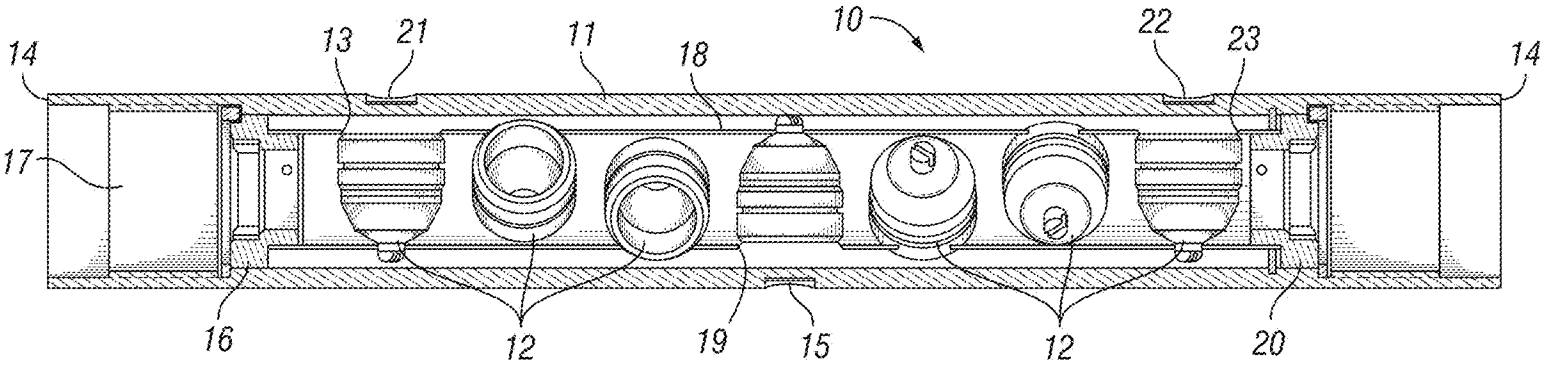
FIG. 1 is a side cross sectioned view of a perforating gun.

Referring to FIG. 1, a typical perforating gun 10 comprises a gun body 11 that houses the shaped charges 12. The gun body 11 contains end fittings 16 and 20 which secure the charge tube 18 into place. The charge tube 18 has charge holes 23 that are openings where shaped charges 12 may be placed. The gun body 11 has threaded ends 14 that allow it to be connected to a series of perforating guns 10 or to other downhole equipment depending on the job requirement. Other design variations may use ends that are bolted together. In FIG. 1, a 60 degree phase gun is shown where each shaped charge 12 is rotate about the center axis by 60 degrees from one shaped charge to the next. Other embodiments of this design are possible including zero degree phase guns, where all the shaped charges are aligned. Other end fittings or connections could be used in lieu of threaded fittings, such as bolted fittings.

Figure 2:
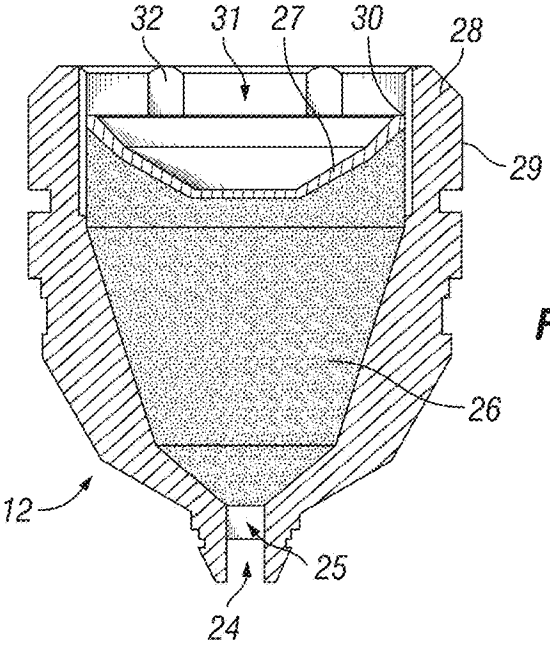
FIG. 2 is a side cross sectioned view of a shaped charge that may be used in a perforating gun.

Referring to FIG. 2, the shaped charges 12 includes a shaped charge case 28 that holds the energetic material 26 and the liner 27. The shaped charge case 12 typically is composed of alloy steel. The liner 27 is usually composed of a powdered metal that is either pressed or stamped into place. The metals used in liner 27 include brass, copper, tungsten, and lead.

In this embodiment the liner 27 and energetic material 26 may be held in place by an adhesive, a snap ring, or some other retaining device. The shaped charge 12 may also include vent holes 32 in order to assist in allowing gases to vent out of the shaped charge 12 if an unplanned deflagration of the energetic material 26 occurs. The detonating cord that initiates the shaped charge 12 is placed in opening 24.

Figure 3A:
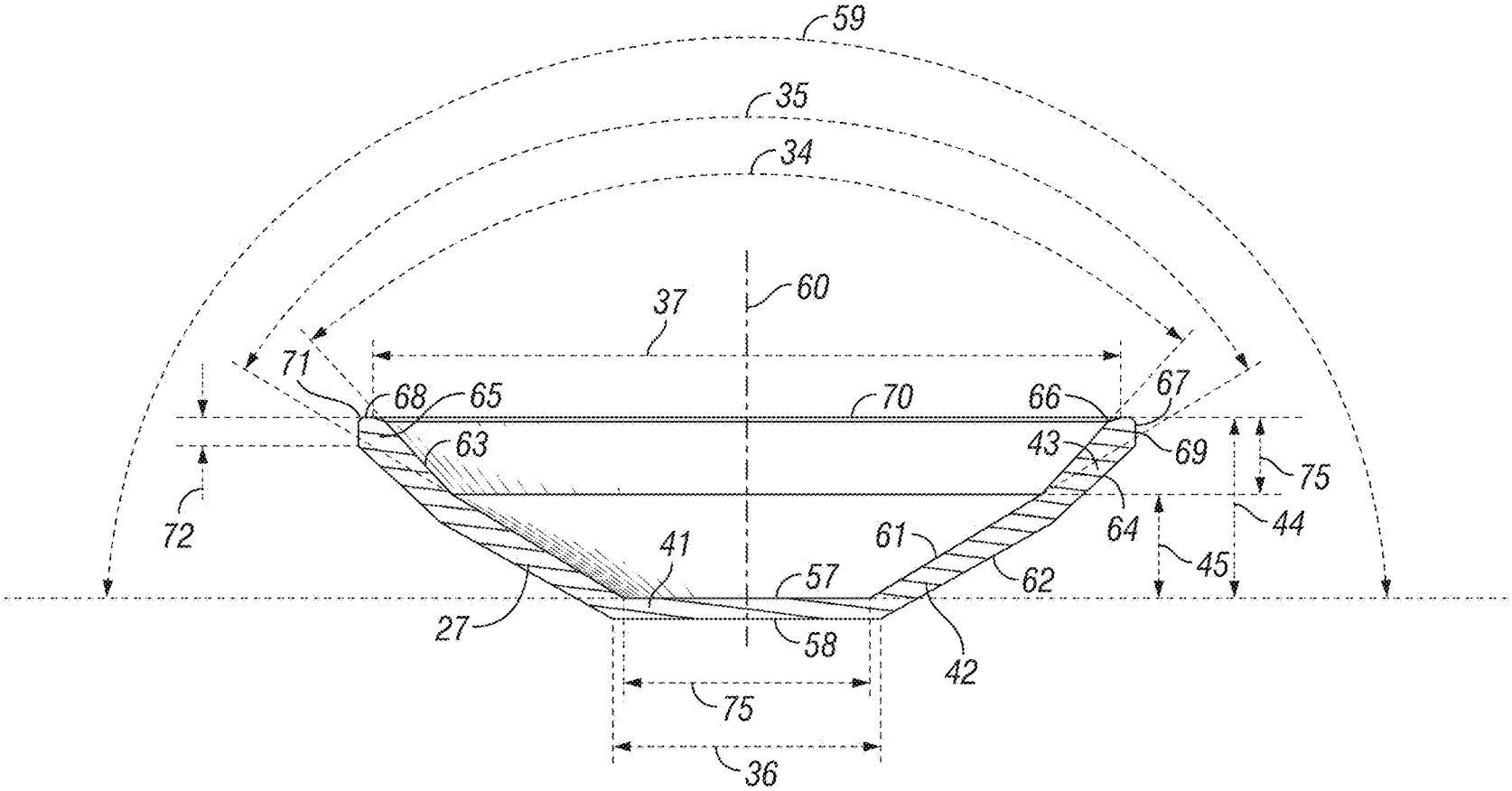
FIG. 3A is a side cross sectioned view of a liner that may be part of a shaped charge.

Referring to FIG. 3A, this is a cross section of the liner 27 in more detail. The liner 27 has a special geometry that aids in allowing it to function as a shaped charge but reduce the likelihood of over-penetration. The liner 27 contains a circular base with a diameter 36. In at least one embodiment the diameter 36 is no more than half of the major diameter 37 of the liner 27. The liner 27 contains a first frusto-conical portion 42 with a first angle of 35. The liner 27 contains a second frusto-conical portion 43 with a second angle 34. The first angle 35 is larger than the second angle 34. The liner 27 has a second height 75. The first frusto-conical portion 42 first height 45 should account for half or more of the total height 44 of the shaped charge.

Figure 3B:
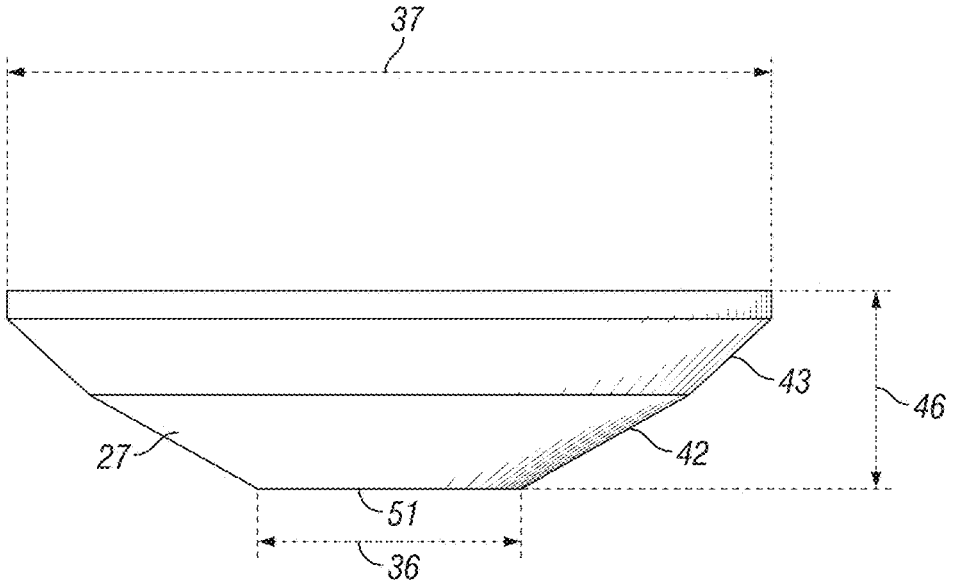
FIG. 3B is a side view of a liner that may be part of a shaped charge.

Referring to FIG. 3B, this is a side view of the liner 27 from the exterior. The liner 27 is an overall bowl shape with a substantially flat bottom 51, a first frusto-conical portion 42 and a second frusto-conical portion 43.

In at least one example of the invention, as depicted in FIG. 3A, the invention comprises a shaped charge liner 27 comprising a first section 41 having a first axis 60, a substantially conical first inner surface 57, a first outer surface 58, and a first conical angle 59 respective to the first inner surface 57, a second section 42 having the same axis 60 as the first section 41, a substantially frusto-conical second inner surface 61, a second outer surface 62, and a second conical angle 35 respective to the second inner surface 61, a third section 43 sharing the same axis 60 as the first section 41 and the second section 42, a substantially frusto-conical third inner surface 63, a third outer surface 64, and a third conical angle 34 respective to the third inner surface 63, wherein the first section 41, second section 42 and third section 43 are axially aligned. The first conical angle 59 is larger than the second conical angle 35 and the second conical angle 35 is larger than the third conical angle 34.

The example in FIG. 3A further comprises a top section 65 having an inner edge 66, an outer edge 67 and a top surface 68, wherein the inner edge 66 is proximate with the third inner surface 63 and the top surface 68 is substantially perpendicular to the first axis. In another example the top section 65 further comprises an exterior cylindrical surface 69 parallel to the shared axis 60 wherein the cylindrical surface 69 is proximate to the third outer surface 64. In another example the second outer surface 62 and the third outer surface 64 are substantially aligned to form a continuous surface. In another example the second section 42 has a first height 45 measured along the first axis from the first inner surface 57 to the third inner surface 63, the third section 43 has a second height 75 measured along the first axis from the second inner surface 61 to the furthest edge of the third inner surface 63, and the second height 75 is the same or less than the length of the first height 45.

In another example the intersection of the inner edge 66 of the top surface 68 and the third inner surface 63 forms a first fillet 70 with a first radius. In another example the intersection of the outer edge 67 of the top surface and the cylindrical surface 69 forms a second fillet 71 with a second radius. In another example the first radius is between approximately 0.015 and 0.025 inches. In another example the second radius is between approximately 0.015 and 0.025 inches. In another example the first inner surface 57 of the first section 41 has a convex shape. The top section could have a larger or smaller radius fillet, or the fillet could be replaced with a chamfer, or that feature could be omitted.

In another example the first inner surface 57 of the first section 41 has a concave shape. In another example the first conical angle 59 is approximately 180 degrees. In another example the first conical angle 59 is less than 180 degrees. In another example the first conical angle 59 is more than 180 degrees.

In another example the first section 41 has a first diameter 36 and top surface 43 has a second diameter 37 the first diameter 36 ratio to the second diameter 37 is between 0.15 and 0.45. In another example the second conical angle 35 is between 100 and 130 degrees. In another example the second conical angle 35 is between 108 and 124 degrees. In another example the first conical angle 59 is less than 180 degrees and the second conical angle 35 is between 100 and 130 degrees. In another example the first conical angle 59 is less than 180 degrees and the second conical angle 35 is between 108 and 124 degrees. In another example the third conical angle 34 is between 56 and 94 degrees. In another example the first conical angle 59 is less than 180 degrees, the second conical angle 35 is between 100 and 130 degrees, and the third conical angle 34 is between 56 and 94 degrees. In another example the first conical angle 59 is less than 180 degrees, the second conical angle 35 is between 108 and 124 degrees, and the third conical angle 34 is between 56 and 94 degrees. In another example the length of the cylindrical surface 72 along the first axis is between 0.030 and 0.040 inches. In another example the second outer surface 62 has a fourth conical angle 73 between 112 and 124 degrees. In another example the third outer surface 64 has a fifth conical angle 74 between 68 and 98 degrees.

In another example the second outer surface 62 has a fourth conical angle 73, the third outer surface 64 has a fifth conical angle 74, and the fourth conical angle 73 is approximately equal to the fifth conical angle 74. In another example the first height 45 is between 0.080 and 0.132 inches. In another example the second height 75 is between 0.140 and 0.240 inches. In another example the first height 45 is between 0.080 and 0.132 inches and the second height 75 is between 0.140 and 0.240 inches. In another example the first height 45 is approximately 0.137 inches, the second height 75 is approximately 0.245 inches, the first conical angle 59 is less than 180 degrees, the second conical angle 35 is approximately 124 degrees, and the third conical angle 34 is approximately 68 degrees. In another example the first height 45 is approximately 0.087 inches, the second height 75 is approximately 0.170 inches, the first conical angle 59 is less than 180 degrees, the second conical angle 35 is approximately 114 degrees, and the third conical angle 34 is approximately 56 degrees. In another example the first height 45 is approximately 0.090 inches, the second height 75 is approximately 0.160 inches, the first conical angle 59 is less than 180 degrees, the second conical angle 35 is approximately 118 degrees, and the third conical angle 34 is approximately 94 degrees.

In another example the first height 45 is approximately 0.123 inches, the second height 75 is approximately 0.235 inches, the first conical angle 59 is less than 180 degrees, the second conical angle 35 is approximately 108 degrees, and the third conical angle 34 is approximately 56 degrees.

In another example the first height 45 is approximately 0.105 inches, the second height 75 is approximately 0.205 inches, the first conical angle 59 is less than 180 degrees, the second conical angle 35 is approximately 114 degrees, and the third conical angle 34 is approximately 62 degrees. In another example the first height 45 is approximately 0.127 inches, the second height 75 is approximately 0.223 inches, the first conical angle 59 is less than 180 degrees, the second conical angle 35 is approximately 118 degrees, and the third conical angle 34 is approximately 94 degrees. In another example the first height 45 is approximately 0.123 inches, the second height 75 is approximately 0.218 inches, the first conical angle 59 is less than 180 degrees, the second conical angle 35 is approximately 124 degrees, and the third conical angle 34 is approximately 62 degrees. In another example the first height 45 is approximately 0.123 inches, the second height 75 is approximately 0.218 inches, the first conical angle 59 is less than 180 degrees, the second conical angle 35 is approximately 124 degrees, and the third conical angle 34 is approximately 62 degrees.

Another example of the invention is a shaped charge 12 comprising a case 28 with a first opening 31 and an inner wall 33 a liner 27 further comprising a first section 41, a second section 42, and a third section 43, the first section having a first axis 60, a substantially conical first inner surface 57, a first outer surface 58, and a first conical angle 59 respective to the first inner surface 57, the second section 42 sharing the same axis 60 as the first section 41, a substantially frusto-conical second inner surface 61, a second outer surface 62, and a second conical angle 35 respective to the second inner surface 61, the third section 43 sharing the same axis 60 as the first section 41, a substantially frusto-conical third inner surface 63, a third outer surface 64, and a third conical angle 34 respective to the third inner surface 63, wherein the first section 41, second section 42 and third section 43 are axially aligned, the first conical angle 59 is larger than the second conical angle 35 and the second conical angle 35 is larger than the third conical angle 34, an explosive 26 located between the liner 27 and the inner wall 33 of the case 28.

Another example of the invention includes a perforating gun 10, comprising at least one shaped charge 12 further comprising, a case 28 with a first opening 31, a second opening 25, and an inner wall 33, a liner 27 further comprising a first section 41 having an axis 60, a substantially conical first inner surface 57, a first outer surface 58, and a first conical angle 59 respective to the first inner surface 57, a second section 42 having sharing the same axis 60 as the first section 41, a substantially frusto-conical second inner surface 61, a second outer surface 62, and a second conical angle 35 respective to the second inner surface 61, a third section 43 having sharing the same axis 60 as the first section 41, a substantially frusto-conical third inner surface 63, a third outer surface 64, and a third conical angle 34 respective to the third inner surface 63, wherein the first section 41, second section 42 and third section 43 are axially aligned, the first conical angle 59 is larger than the second conical angle 35 and the second conical angle 35 is larger than the third conical angle 34, and a gun carrier housing 18 adapted to contain the at least one shaped charge 12.

Figure 4A:
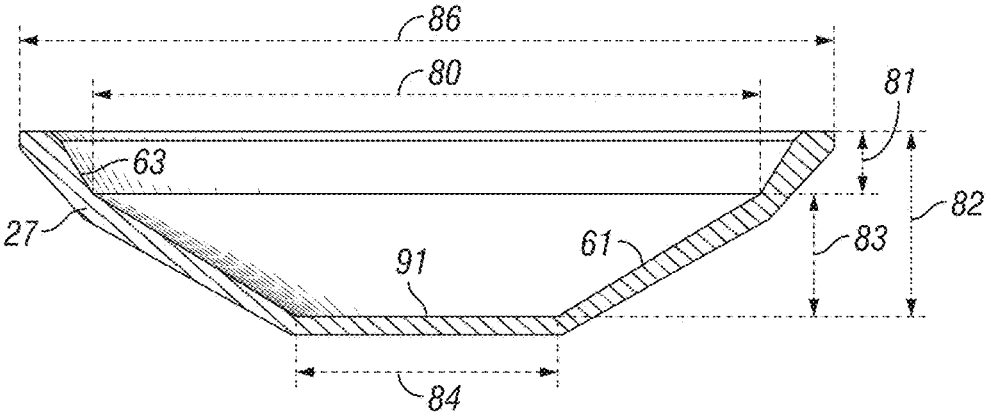
FIG. 4A is a side cross sectioned view of a liner that may be part of a shaped charge.

Referring to FIG. 4A, another example of the invention includes a shaped charge liner 27 with a first inside diameter 60 located at an inside height 83 from surface 91. The shaped charge liner 27 has an overall inside height 82 from the surface 91 to the top of the liner. The height 81 is the difference between inside height 83 and the overall inside height 82. The Shaped charge has a second inside diameter 84 for the surface 91. The shaped charge liner 27 also has an overall diameter 86.

Figure 4B:
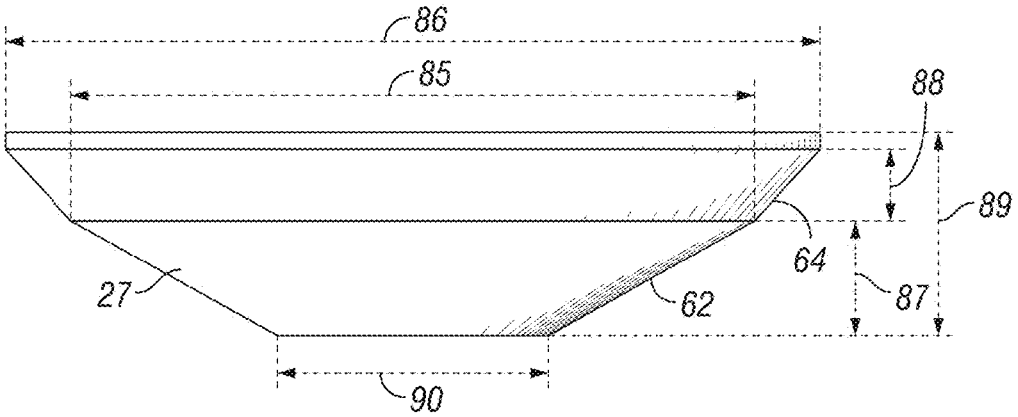
FIG. 4B is a side view of a liner that may be part of a shaped charge.

Referring to FIG. 4B, in the same example of the invention, the shaped charge liner 27 has an overall outside height 89. It has a first outside height 87 and a second outside height 88. The embodiment has an outer base diameter 90 and an overall diameter 86. The middle diameter 85 is at the first outside height 87.

Referring to FIG. 4A, the embodiment has several ratios that control the shape of the shaped charge liner 27. The inside height 83 is between 45 and 70 percent of the height of the overall inside height 82. The height 81 is between 30 and 55 percent of the overall inside height 82. The second inside diameter 84 is between 15 and 40 percent of overall diameter 86. The first inside diameter 80 is between 70 and 85 percent of overall diameter 86.

Referring to FIG. 4B, the embodiment has several rations that control the shape of the shaped charge liner 27. The first outside height 87 is between 40 and 63 percent of overall outside height 89. The second outside height 88 is between 24 and 53 percent of overall outside height 89. The outbase diameter 90 is between 15 and 45 percent of overall diameter 86. The middle diameter 85 is between 70 and 90 percent of overall diameter 86.

An example of the invention includes a method of perforating a well comprising providing a perforating gun, mounting at least one shaped charge in the perforating gun, the shaped charge comprising a casing, placing a liner within said casing, said liner comprising, a first axis, a substantially conical first inner surface, a first outer surface, and a first conical angle respective to the first inner surface, a second section having a second axis, a substantially frusto-conical second inner surface, a second outer surface, and a second conical angle respective to the second inner surface, a third section having a third axis, a substantially frusto-conical third inner surface, a third outer surface, and a third conical angle respective to the third inner surface, wherein the first section, second section and third section are axially aligned, the first conical angle is larger than the second conical angle and the second conical angle is larger than the third conical angle, placing an explosive material disposed in between said liner and said casing, connecting a firing head to the perforating gun, placing the perforating gun in said well at a desired location within the well, and detonating the at least one shaped charge at the desired location.

Although the invention has been described in terms of particular embodiments which are set forth in detail, it should be understood that this is by illustration only and that the invention is not necessarily limited thereto. Alternative embodiments and operating techniques will become apparent to those of ordinary skill in the art in view of the present disclosure. Accordingly, modifications of the invention are contemplated which may be made without departing from the spirit of the claimed invention.

What is claimed is:

1. A shaped charge explosive comprising:

a case with a first opening and an inner wall;

a liner further comprising a closed bottom, an open top, an axis, an outer surface, a first section, a second section, and a third section;

the first section having a substantially conical first inner surface, and a first conical angle respective to the first inner surface;

the second section having a substantially frusto-conical second inner surface, and a second conical angle respective to the second inner surface;

the third section having a substantially frusto-conical third inner surface, and a third conical angle respective to the third inner surface;

wherein the first section, second section and third section are axially aligned about the axis, the first conical angle is larger than the second conical angle and the second conical angle is larger than the third conical angle;

an explosive located between the liner and the inner wall of the case.

2. The apparatus of claim 1, wherein the liner has a first inner height measured along the first axis from the first inner surface to a plane perpendicular to the intersection of the second inner surface and the third inner surface, the liner having an overall inner height measured from the first inner surface to a plane perpendicular to the open top of the liner, and the inner height is between 0.45 and 0.7 of the overall inner height.

3. The apparatus of claim 2, wherein the liner has a second inner height measured along the axis from a plane perpendicular to the intersection of the second inner surface and the third inner surface to a plane perpendicular to the open top of the liner, the liner having an overall inner height measured from the first inner surface to a plane perpendicular to the top of the liner, and the second inner height being between 0.3 and 0.55 of the overall inner height.

4. The apparatus of claim 1, wherein the liner has an overall diameter represented by the open top of the liner, a first inner diameter represented by the intersection of the first inner surface and the second inner surface, in which the first inner diameter is between 0.15 and 0.4 of the overall diameter.

5. The apparatus of claim 1, wherein the liner has an overall inner diameter represented by the open top of the liner, a first inner diameter represented by the intersection of the second inner surface and the third inner surface, in which the second inner diameter is between 0.7 and 0.85 of the overall inner diameter.

6. The apparatus of claim 1, wherein the liner has a first outer height measured along the first axis from the closed bottom of the liner to an angle break on the outer surface of the liner, the liner having an overall outer height measured along the axis from the closed bottom of the liner to a plane perpendicular to the open top of the liner, and the first outer height being between 0.4 and 0.63 of the overall outer height.

7. The apparatus of claim 1, wherein the liner has a second outer height measured along the axis from an angle break on the outer surface of the liner to a plane perpendicular to the top of the liner, the liner having an overall outer height measured along the first axis from the closed bottom of the liner to a plane perpendicular to the open top of the liner, and the second outer height being between 0.3 and 0.55 of the overall outer height.

8. The apparatus of claim 1, wherein the liner has an overall outer diameter represented by the top of the liner and a first outer diameter represented by the bottom of the liner, in which the first outer diameter is between 0.15 and 0.45 of the overall diameter.

9. The apparatus of claim 1, wherein the liner has an overall outer diameter represented by the top of the liner and a second outer diameter represented by diameter of the liner at the angle break of the outer surface, in which the second outer diameter is between 0.7 and 0.9 of the overall outer diameter.

10. The apparatus of claim 1, wherein the first inner surface of the first section has a convex shape.

11. The apparatus of claim 1, wherein the first inner surface of the first section has a concave shape.

12. The apparatus of claim 1, wherein the first conical angle is approximately 180 degrees.

13. The apparatus of claim 1, wherein the first conical angle is more than 180 degrees.

14. The apparatus of claim 1, wherein the second conical angle is between 108 and 124 degrees.

15. The apparatus of claim 1, wherein the third conical angle is between 56 and 94 degrees.

16. The apparatus of claim 1, wherein the first conical angle is less than 180 degrees, the second conical angle is between 100 and 130 degrees, and the third conical angle is between 56 and 94 degrees.

17. The apparatus of claim 1, wherein the first conical angle is less than 180 degrees, the second conical angle is between 108 and 124 degrees, and the third conical angle is between 56 and 94 degrees.

18. The apparatus of claim 3, wherein the first inner height is between 0.080 and 0.132 inches and the second inner height is between 0.140 and 0.240 inches.

19. A perforating gun comprising:

at least one shaped charge further comprising:

a case with a first opening, a second opening, and an inner wall;

a liner further comprising a closed bottom, an open top, an axis, an outer surface, a first section, a substantially conical first inner surface, and a first conical angle respective to the first inner surface;

a second section having, a substantially frusto-conical second inner surface, and a second conical angle respective to the second inner surface;

a third section having, a substantially frusto-conical third inner surface, and a third conical angle respective to the third inner surface;

wherein the first section, second section and third section are axially aligned about the axis, the first conical angle is larger than the second conical angle and the second conical angle is larger than the third conical angle;

a gun carrier housing adapted to contain the at least one shaped charge.

20. The perforating gun of claim 19, wherein the liner has a first inner height measured along the first axis from the first inner surface to a plane perpendicular to the intersection of the second inner surface and the third inner surface, the liner having an overall inner height measured from the first inner surface to a plane perpendicular to the open top of the liner, and the inner height is between 0.45 and 0.7 of the overall inner height.

21. The perforating gun of claim 20, wherein the liner has a second inner height measured along the axis from a plane perpendicular to the intersection of the second inner surface and the third inner surface to a plane perpendicular to the open top of the liner, the liner having an overall inner height measured from the first inner surface to a plane perpendicular to the top of the liner, and the second inner height being between 0.3 and 0.55 of the overall inner height.

22. The perforating gun of claim 19, wherein the liner has an overall diameter represented by the open top of the liner, a first inner diameter represented by the intersection of the first inner surface and the second inner surface, in which the first inner diameter is between 0.15 and 0.4 of the overall diameter.

23. The perforating gun of claim 19, wherein the liner has an overall inner diameter represented by the open top of the liner, a first inner diameter represented by the intersection of the second inner surface and the third inner surface, in which the second inner diameter is between 0.7 and 0.85 of the overall inner diameter.

24. The perforating gun of claim 19, wherein the liner has a first outer height measured along the first axis from the closed bottom of the liner to an angle break on the outer surface of the liner, the liner having an overall outer height measured along the axis from the closed bottom of the liner to a plane perpendicular to the open top of the liner, and the first outer height being between 0.4 and 0.63 of the overall outer height.

25. The perforating gun of claim 19, wherein the liner has a second outer height measured along the axis from an angle break on the outer surface of the liner to a plane perpendicular to the top of the liner, the liner having an overall outer height measured along the first axis from the closed bottom of the liner to a plane perpendicular to the open top of the liner, and the second outer height being between 0.3 and 0.55 of the overall outer height.

26. The perforating gun of claim 19, wherein the liner has an overall outer diameter represented by the top of the liner and a first outer diameter represented by the bottom of the liner, in which the first outer diameter is between 0.15 and 0.45 of the overall diameter.

27. The perforating gun of claim 19, wherein the liner has an overall outer diameter represented by the top of the liner and a second outer diameter represented by diameter of the liner at the angle break of the outer surface, in which the second outer diameter is between 0.7 and 0.9 of the overall outer diameter.

28. The perforating gun of claim 19, wherein the first inner surface of the first section has a convex shape.

29. The perforating gun of claim 19, wherein the first inner surface of the first section has a concave shape.

30. The perforating gun of claim 19, wherein the first conical angle is approximately 180degrees.

31. The perforating gun of claim 19, wherein the first conical angle is more than 180 degrees.

32. The perforating gun of claim 19, wherein the second conical angle is between 108 and 124 degrees.

33. The perforating gun of claim 19, wherein the first conical angle is less than 180 degrees and the second conical angle is between 108 and 124 degrees.

34. The perforating gun of claim 19, wherein the third conical angle is between 56 and 94 degrees.

35. The perforating gun of claim 19, wherein the first conical angle is less than 180 degrees, the second conical angle is between 108 and 124 degrees, and the third conical angle is between 56 and 94 degrees.

36. The perforating gun of claim 19, wherein the first inner height is between 0.080 and 0.132 inches.

37. The perforating gun of claim 20, wherein the second inner height is between 0.140 and 0.240 inches.

38. The perforating gun of claim 19, wherein the first height is between 0.080 and 0.132 inches and the second height is between 0.140 and 0.240 inches.

39. A method of perforating a well, comprising:

providing a perforating gun;

mounting at least one shaped charge in the perforating gun, placing a liner within a casing, said liner comprising:

an axis, a closed bottom, an open top, an outer surface;

a first section having a substantially conical first inner surface, and a first conical angle respective to the first inner surface;

a second section having a substantially frusto-conical second inner surface, and a second conical angle respective to the second inner surface; and a third section having a substantially frusto-conical third inner surface, and a third conical angle respective to the third inner surface, wherein the first section, second section and third section are axially aligned, the first conical angle is larger than the second conical angle and the second conical angle is larger than the third conical angle;

placing an explosive material disposed in between said liner and said casing;

connecting a firing head to the perforating gun;

placing the perforating gun in said well at a desired location within the well; and detonating the at least one shaped charge at the desired location.

40. The method of claim 39, wherein the liner has a first inner height measured along the first axis from the first inner surface to a plane perpendicular to the intersection of the second inner surface and the third inner surface, the liner having an overall inner height measured from the first inner surface to a plane perpendicular to the open top of the liner, and the inner height is between 0.45 and 0.7 of the overall inner height.

41. The method of claim 39, wherein the liner has a second inner height measured along the axis from a plane perpendicular to the intersection of the second inner surface and the third inner surface to a plane perpendicular to the open top of the liner, the liner having an overall inner height measured from the first inner surface to a plane perpendicular to the top of the liner, and the second inner height being between 0.3 and 0.55 of the overall inner height.

42. The method of claim 39, wherein the liner has an overall diameter represented by the open top of the liner, a first inner diameter represented by the intersection of the first inner surface and the second inner surface, in which the first inner diameter is between 0.15 and 0.4 of the overall diameter.

43. The method of claim 39, wherein the liner has an overall inner diameter represented by the open top of the liner, a first inner diameter represented by the intersection of the second inner surface and the third inner surface, in which the second inner diameter is between 0.7 and 0.85 of the overall inner diameter.

44. The method of claim 39, wherein the liner has a first outer height measured along the first axis from the closed bottom of the liner to an angle break on the outer surface of the liner, the liner having an overall outer height measured along the axis from the closed bottom of the liner to a plane perpendicular to the open top of the liner, and the first outer height being between 0.4 and 0.63 of the overall outer height.

45. The method of claim 39, wherein the liner has a second outer height measured along the axis from an angle break on the outer surface of the liner to a plane perpendicular to the top of the liner, the liner having an overall outer height measured along the first axis from the closed bottom of the liner to a plane perpendicular to the open top of the liner, and the second outer height being between 0.3 and 0.55 of the overall outer height.

46. The method of claim 39, wherein the liner has an overall outer diameter represented by the top of the liner and a first outer diameter represented by the bottom of the liner, in which the first outer diameter is between 0.15 and 0.45 of the overall diameter.

47. The method of claim 39, wherein the liner has an overall outer diameter represented by the top of the liner and a second outer diameter represented by diameter of the liner at the angle break of the outer surface, in which the second outer diameter is between 0.7 and 0.9 of the overall outer diameter.

48. The method of claim 39, wherein the first inner surface of the first section has a convex shape.

49. The method of claim 39, wherein the first inner surface of the first section has a concave shape.

50. The method of claim 39, wherein the first conical angle is approximately 180 degrees.

51. The method of claim 39, wherein the first conical angle is more than 180 degrees.

52. The method of claim 39, wherein the second conical angle is between 108 and 124 degrees.

53. The method of claim 39, wherein the first conical angle is less than 180 degrees and the second conical angle is between 108 and 124 degrees.

54. The method of claim 39, wherein the third conical angle is between 56 and 94 degrees.

55. The method of claim 39, wherein the first conical angle is less than 180 degrees, the second conical angle is between 108 and 124 degrees, and the third conical angle is between 56 and 94 degrees.

* * * * *